US007049405B2

(12) United States Patent
Gosline et al.

(10) Patent No.: US 7,049,405 B2
(45) Date of Patent: May 23, 2006

(54) α-HELICAL PROTEIN BASED MATERIALS AND METHODS FOR MAKING SAME

(75) Inventors: John Gosline, Vancouver (CA); Douglas Fudge, Vancouver (CA); Paul Guerette, Vancouver (CA)

(73) Assignee: The University of British Columbia, Vancouver (CA)

( * ) Notice: Subject to any disclaimer, the term of this patent is extended or adjusted under 35 U.S.C. 154(b) by 0 days.

(21) Appl. No.: 10/917,376

(22) Filed: Aug. 13, 2004

(65) Prior Publication Data

US 2005/0034280 A1 Feb. 17, 2005

Related U.S. Application Data

(63) Continuation-in-part of application No. PCT/CA03/00223, filed on Feb. 14, 2003.

(60) Provisional application No. 60/356,144, filed on Feb. 14, 2002.

(51) Int. Cl.
*A61K 38/17* (2006.01)

(52) U.S. Cl. ..... 530/353; 530/402

(58) Field of Classification Search ..... 530/353, 530/402

See application file for complete search history.

(56) References Cited

U.S. PATENT DOCUMENTS 5,773,577 A 6/1998 Cappello
6,033,654 A 3/2000 Stedronsky et al.

FOREIGN PATENT DOCUMENTS

WO WO 94/29450 12/1994

OTHER PUBLICATIONS

Fudge et al. Mechanical and Optical Properties of Hagfish Slime Threads. American Zoologist. Dec. 2000 40, 6, p. 1021.*

Hearle. A Critical Review of the Structural Mechanics of Wool and Hair Fibres. International Journal of Biological Macromolecules. 2000. 27, 123-138.*

Abumuhor, I. A., Spencer, P. H. and Cohlberg, J.A. (1998). The pathway of assembly of intermediate filaments from recombinant* Jour. of Structural Biology 123, 187-198.

Candelas, G.C., A. Ortiz and N. Ortiz (1988). Features of cell-free translation of a spider fibroin mRNA. Cell Biol. 67:173-176.

Cerda, J., Conrad, M., Markl, J., Brand, M. and Herrmann, H. (1998). Zebrafish vimentin: molecular characterization, assembly properties* Eur Jour.of Cell Biology 77, 175-187.

Cusack, S., Belrhali, H., Bram, A., Burghammer, M., Perrakis, A. and Riekel, C. (1998). Small is beautiful: protein micro-crystallography. Nature Structural Biology 5, 634-637.

Denny, M. (1976). The physical properties of spiders silk and their role in the design of orb webs. Journal of Experimental Biology 65, 483-506.

Downing, S. W., Spitzer, R.H., Salo, W.L., Downing, S.D., Saidel, L.J., Koch, E.A. (1981). Hagfish slime gland thread cells: organization, biochemical* Science 212, 326-328.

Fahnestock SR, Yao Z, Bedzyk LA (2000). Microbial production of spider silk proteins (2000) Reviews in Mol. Biotech. 74(2):105-19.

Fernholm, B. (1981). Thread cells from the slime glands of hagfish (Myxinidae). Acta Zoologica 62, 137-145.

Fradette, J., Germain, L., Seshalah, P. and Coulombe, P. A. (1998). The type I keratin 19 possesses distinct and context-dependent* Jml of Biological Chem 273, 35176-35184.

Fraser, R.D.B, MacRae, T.P., Parry, D.A.D. Suzuki, E. (1969). Structure of b-keratin. Polymer. 10, 810-26.

(Continued)

*Primary Examiner*—Jon Weber
*Assistant Examiner*—Suzanne M. Mayer
(74) *Attorney, Agent, or Firm*—Oyen Wiggs Green & Mutala LLP

(57) ABSTRACT

The invention relates to a method of producing useful materials from filament-forming α-helical proteins or filaments made of such proteins. The method comprises allowing filament-forming α-helical proteins to self-assemble into α-helix containing filaments and forming fibres, films or bulk materials from the filaments. The materials are stretched to strain the filaments so that the α-helices substantially irreversibly change to β-sheet forms. The filament-forming α-helical proteins can comprise intermediate filament proteins. In a specific embodiment, the filament-forming proteins comprise hagfish slime thread IF proteins.

38 Claims, 6 Drawing Sheets

OTHER PUBLICATIONS

Frederick SE, Mangan ME, Carey JB, Gruber PJ. Intermediate filament antigents of 60 and 65 kDa in the nuclear matrix of plants: their det* (1992) Exp Cell Res. 199(2):213-22.
Fuchs, E. and Cleveland, D. W. (1998). A structural scaffolding of intermediate filaments in health and disease. Science 279, 514-9.
Guerette, P. A., Ginzinger, D. G., Weber, B. H. F. and Gosline, J.M. (1996). Silk properties determined by gland-specific expression of a spider fibroin* Sci. 272, 112-115.
Hargreaves AJ, Goodbody KC, Lloyd CW. Reconstitution of intermediate filaments from a higher plant (1989). Biochem J. 261(2):679-82.
Hearle, J. W. (2000). A critical review of the structural mechanics of wool and hair fibers. International Journal of Biological Macromolecules 27, 123-38.
Herrmann, H. et al. (2000). Critical evaluation of the distinct steps of intermediate* Mol. Biol. of the Cell 11, (supplement, Dec) Abstract #2762, p. 534a).
Herrmann, H. et al. (2000). The intermediate filament protein consensus motif of helix 2B: Atomic structure* J. Mol. Biol. 298:817-832.
Hofmann, I., Herrmann, H. and Franke, W. W. (1991). Assembly and structure of calcium-induced thick vimentin filaments. European Journal of Cell Biology 56, 328-41.
Jannatipour, M. and Rokeach, L.A. (1998). A Schizosaccharomyces pombe gene encoding a novel polypeptide with a predicted alpha-helical* Biochim Biophys Acta, 30;1399(1):67.
Knight, D. P., Knight, M. M. and Vollrath, F. (2000). Beta transition and stress-induced phase separation in the spinning of spider* Int. J. Biol. Macro. 27, 205-10.
Koch, E. A., Spitzer, R. H., Pithawalla, R. B. and Parry, D. A. (1994). An unusual intermediate filament subunit from the cytoskeletal* Journal of Cell Science 107, 3133-44.
Koch, E.A., Spitzer, R. H., Pithawalla, R.B., Castillos, F. A., 3rd and Parry, D. A. (1995). Hagfish biopolymer: a type I/type II* Int. Journ.of Biol. Macro. 17, 283-92.
Lazaris, A., et al., (2002). Spider silk fibers spun from soluble recombinant silk produced in mammalian cells. Science 295, 472-476.
Ma et al., A 'hot-spot' mutation alters the mechanical properties of keratin filament networks, Nat. Cell Biol. 3(5):503-506 (2001).
Mack, J.W. et al., The mechanism of interaction of filaggrin with intermediate filaments: The ionic zipper hypothesis J. Mol. Biol. 232: 50-66 (1993).
Matoltsty, A.G. (1965) In "Biology of Skin and Hair Growth" (A.G. Lyne and B. F. Short, ed.), Angus and Robertson, Sydney.
Masuda K, et al., (1997). Peripheral framework of carrot cell nucleus contains a novel protein predicted to exhibit a long alpha-helical* Exp Cell Res. 10;232(1):173-81.
Pandey, A (2001). Plants to make silk. Trends Genet. 2001 17(8):442.
Parry, D. A. and Steinert, P. M. (1999). Intermediate filaments: molecular architecture, assembly, dynamics and polymorphism. Quarterly Reviews of Biophysics 32, 99-187.
Porter, R. M., et al. (1998). cDNA cloning, expression, and assembly characteristics of mouse* Jour. of Biol. Chem. 273, 32265-32272.
Puchtler, H., Waldrop, F, S. and Meloan, S. N. (1985), A review of light, polarization and fluorescence microscopic methods for amytoid. Appl. Pathol. 3, 5-17.
Riekel, C., Madsen, B., Knight, D. and Vollrath, F. (2000). X-ray diffraction on spider silk during controlled extrusion under a synchroton* Biomacromol. 1, 622-26.
Scheller J, Guhrs KH, Grosse F, Conrad U. Production of spider silk proteins in tobacco and potatos (2001). Nat Biotechnol. 19(6):573-7.
Spitzer, R. H., et al. (1984). Hagfish slime gland thread cells. II. Isolation and characterization of intermediated filament components* Journal of Cell Biology 98, 670-7.
Spitzer, R. H., Koch, E. A. and Downing, S. W. (1988). Maturation of hagfish gland thread cells: composition and characterization* Cell Motility & the Cytoskeleton 11, 31-45.
Steinbock FA, et al., Dose-dependent linkage, assembly inhibition and disassembly of vimentin and cytokeratin 5/14 filaments through* J. Cell Sci. 113(3):483-491 (2000).
Vollrath, F. and Knight, D. P. (2001). Liquid crystalline spinning of spider silk. Nature 410, 541-548.
Wang, J. et al., (2000). The epidermal intermediate filament proteins of tunicates are distant keratins; a polymerisation-competent* Eur. Journal of Cell Biology 79, 478-487.
Wang, N. and Stamenovic, D. (2000). Contribution of intermediate filaments to cell stiffness, stiffening, and growth. American J. of Physiology—Cell Physiol 279, C188-94.
Work, R. W. (1982). A physico-chemical study of the supercontraction of spider major ampullate fibers. Textile Research Journal 59, 349-356.
Wu, K. C. et al., (2000). Coiled-coil trigger motifs in the 1B and 2B rod domain segments are required for the stability of keratin* Mol. Biol. of the Cell 11, 3539-3558.
Yoon, M. et al. (2000). The motile properties and assembly states of intermediate filament (IF)* Mol. Biol. of the Cell 11 (supplement, Dec.) Abstract #2765, p. 534a.
Gatesy, John et al., Extreme Diversity, Conservation, and Convergence of Spider Silk Fibroin Sequences, Science vol. 291:2603-2605 (2001).
Hayashi, Cheryl Y. et al., Evidence from Flagelliform Silk cDNA for the Structural Basis of Elasticity and Modular Nature of Spider Silks, J. Mol. Biol. 275:773-784 (1998).
Herrmann, H., Aebi, U., Intermediate filament assembly: temperature sensitivity and polymorphism, Cell Mol. Life Sci. 55:1416-1431 (1999).
O'Brien, J.P. et al., (1994) Design, synthesis and fabrication of a novel self-assembling fibrillar protein, In: Silk Polymers. Amer. Chem. Soc. pp. 104-117.
Storm, Cornelius et al. (2005) Nonlinear elasticity in bilogical gels, Nature 435:191-194.
Cvais-Steider et al., (1983) Structural Similarities and Differences Amongst Neurofilaments. J. Mol. Biol. 165:393-400.

* cited by examiner

α-HELICAL PROTEIN BASED MATERIALS AND METHODS FOR MAKING SAME

CROSS REFERENCE TO RELATED APPLICATION

This application is a continuation-in-part of PCT application No. PCT/CA03/00223, filed on 14 Feb. 2003 and published on 21 Aug. 2003 under Article 21(2) in English, and claims the benefit of application No. 60/356,144 filed on 14 Feb. 2002.

1. Technical Field

This invention relates to biological polymers and materials made from biological polymers. Specific embodiments of the invention provide methods for making fibres, films, or other bulk materials that are useful in industrial applications including textiles and high performance materials.

2. Background

In the search for new materials for industry, researchers are looking more and more to biology for inspiration. This "biomimetics" approach is driven by the desire for materials that are not only ecologically-friendly in their production and degradation, but also exceptional in their material properties. Spider dragline silk is a classic example, exhibiting strength greater than steel on a per-weight basis (Denny, 1976; Vollrath and Knight, 2001). Such a material has enormous market potential, and it is not surprising that investment in research toward the production of artificial dragline silk has been intense over the past two decades. Unfortunately, advances toward the production of spider silk on an industrial scale have been slow.

A main complication in the effort to produce biomimetic spider silk is that genes for silk proteins are large and repetitive (Fahenstock et al., 2000; Gatesy et al., 2001; Guerette et al., 1996 and Hayashi and Lewis 2000). This makes their maintenance in expression vectors difficult.

As desirable as the mechanical properties of spider silk are, there is a serious drawback to the use of dragline-like fibres in industry. In the dry state, dragline silk exhibits impressive strength and toughness. However, when it is hydrated, dragline undergoes a process known as "supercontraction" in which it shrinks to about 50% of its original length (Work, 1982).

There remains a need for strong fibres that are suitable for industrial exploitation in fields such as textile manufacturing.

SUMMARY OF THE INVENTION

This invention relates to a method of making industrially useful materials from filament-forming α-helical proteins. The materials are made by forming fibres, films, or other bulk materials from α-helical filaments which comprise assembled filament-forming α-helical proteins. The α-helical filaments are then stretched. The filaments may be stretched by straining the fibres, films, or other bulk materials. In some embodiments, the α-helical filaments are stretched by repeatedly applying a load and removing the load. In alternative embodiments, the α-helical filaments are stretched during the process of forming fibres, films, or other bulk materials. Upon stretching, α-helices in the protein filaments are converted to β-sheet forms, which may include β-sheet crystals. The materials retain their β-sheet structure even after the stretching is discontinued. This alters the mechanical properties of the filaments. The fibres, films, or other bulk materials can be applied in a wide variety of applications.

The filament-forming α-helical proteins may be associated to form any of various types of α-helical filaments including coiled coils or higher order structures including, without limitation, intermediate filaments (IFs). In specific embodiments of the invention, the α-helical filaments comprise hagfish slime thread IFs or filaments made up of proteins which are homologous to hagfish slime thread proteins. In certain preferred embodiments of the invention, the α-helical filaments are not associated with a protein matrix.

The proteins may be isolated directly from natural sources. The proteins may also be recombinantly produced through in vivo or in vitro expression systems. In such cases the gene sequence for the desired proteins is cloned into expression vectors and expressed. The proteins may also be synthesized through cell free translation systems, or through chemical peptide synthesis protocols.

The α-helical filaments may additionally be cross-linked to provide additional strength to the materials made from them. In addition, or in the alternative, the α-helical filaments may be plasticized to confer desired physical attributes.

The invention also relates to materials made according to the above methods, and uses of the materials in industry.

Another aspect of the invention provides a material consisting essentially of filament-forming α-helical proteins, at least 5% by weight of the material being in a β-sheet form when the material is in a substantially unstrained state.

Further aspects of the invention and features of specific embodiments of the invention are described below.

BRIEF DESCRIPTION OF THE DRAWINGS

In drawings which illustrate embodiments of the invention but which should not be construed to limit the scope of the invention.

DESCRIPTION

Throughout the following description specific details are set forth in order to provide a more thorough understanding of the invention. However, the invention may be practiced without these particulars. In other instances, well known elements have not been shown or described in detail to avoid unnecessarily obscuring the present invention. Accordingly, the specification and drawings are to be regarded in an illustrative, rather than a restrictive, sense.

We have developed methods for producing strong, industrially useful materials based on filament-forming α-helical proteins. In particular, we have discovered that fibres, films, and bulk materials formed from certain classes of α-helical filaments are substantially irreversibly transformed when stretched. In some embodiments, the filaments are IFs. In specific embodiments, the IFs comprise hagfish slime thread IFs. Upon stretching, the α-helical structure converts into a β-sheet form, which alters the mechanical properties of the materials. Once stretched to a certain point, the proteins substantially remain in a β-sheet conformation even when stretching forces have been removed.

The methods of the invention can be used to produce strong, industrially useful fibres, films, and bulk materials.

1.0 General Description of a Method of the Invention

Figure 1:
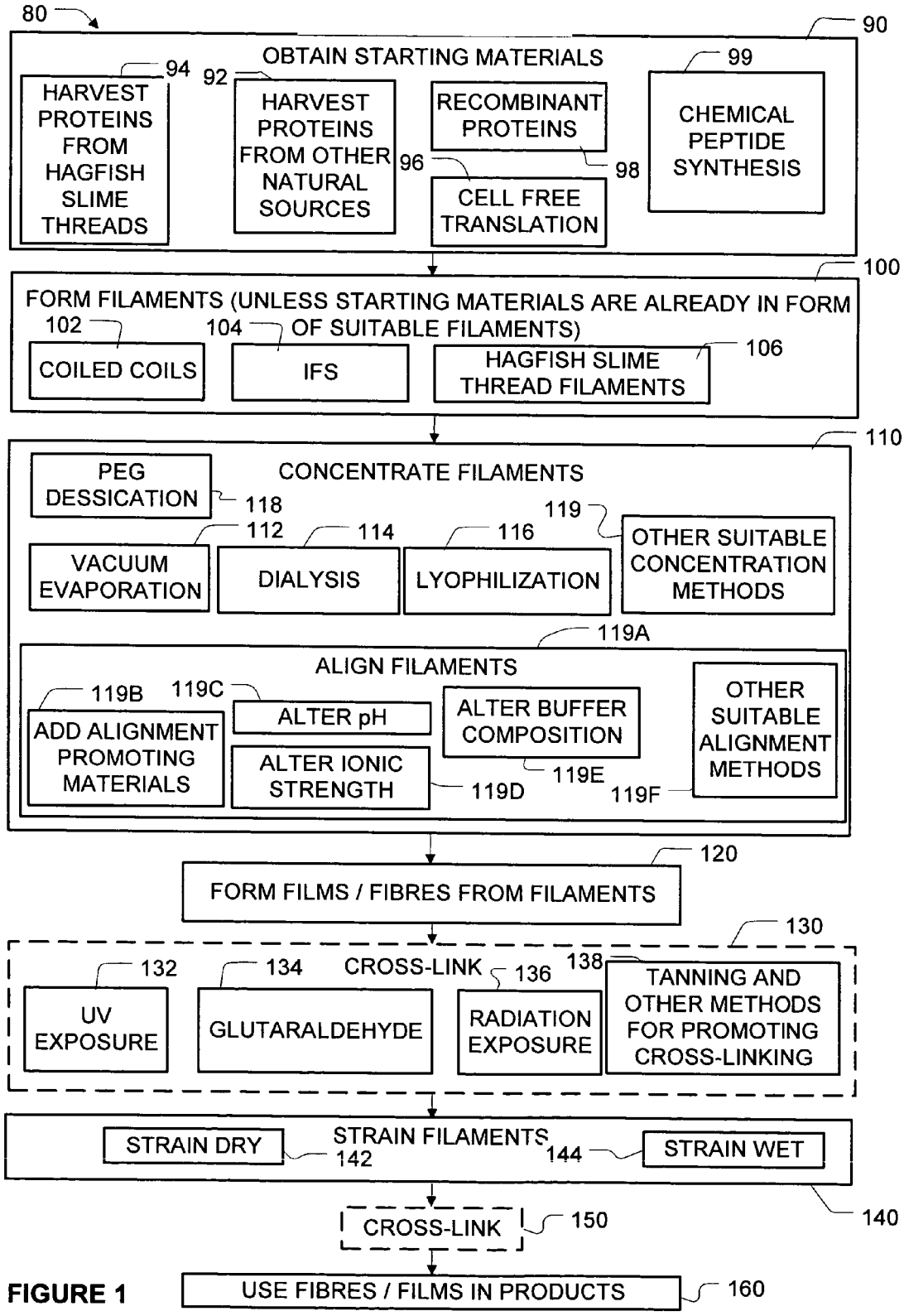
FIG. 1 is a block diagram illustrating a method according to the invention.

FIG. 1 is a block diagram illustrating a general scheme 80 for producing strong, industrially useful materials from filament-forming α-helical proteins. At block 90, starting materials comprising filament-forming α-helical proteins are obtained. These filament-forming proteins may be harvested and isolated from natural sources (block 92) including the specific case where the proteins are obtained from hagfish, which may include hagfish of the species *Eptatretus stoutii* (block 94). In preferred embodiments of the invention the filament-forming α-helical proteins are obtained by methods such as cell free translation (block 96), recombinant methods (block 98), or chemical peptide synthesis (block 99).

The filament-forming α-helical proteins may comprise any proteins that will form α-helical filaments. The filaments can include coiled coils and IFs. In a specific embodiment, the α-helical filaments comprise hagfish slime threads composed largely of α-helical IF proteins.

The starting materials may already be in the form of suitable filaments. Suitable filaments may be obtained, for example, by extracting hagfish slime thread IFs.

If the starting materials are not already in the form of filaments then, in block 100 the starting materials are formed into filaments. The filaments are typically nanoscale filaments having diameters in the range of 1 to 15 nanometers. In preferred embodiments of the invention the filament-forming α-helical proteins are allowed to self-assemble to form nanoscale filaments. Suitable enzymes or substrates may be optionally added to promote assembly of the filament-forming proteins into filaments. In general, self assembly can be promoted by placing the starting materials in an environment which provides appropriate conditions for self-assembly. Conditions under which the protein constituents of a wide variety of IFs will self-assemble to form IFs are described in the literature. Conditions under which the protein constituents of hagfish slime threads self-assemble to form hagfish slime thread filaments are described in Spitzer (1984) and Spitzer (1988). Typically self assembly occurs best at lower concentrations of the protein starting materials in the range of about 0.05 mg/ml to about 1 mg/ml and most typically approximately 0.2 mg/ml.

The filaments formed in block 100 can take various forms including, most generally, coiled coil forms (block 102), or more specifically IF forms (block 104) and even more specifically hagfish slime thread IFs (block 106).

α-helically coiled protein filaments obtained in block 100 are concentrated in block 110 to concentrations suitable for forming the filaments into fibres, films, and bulk materials. The required concentration will depend to some degree upon the particular technique used to form the filaments into larger structures such as fibres, films, and bulk materials. Where the filaments are spun into fibres, concentrations in excess of 1 mg/ml are preferred. Concentrations of 10 mg/ml or even higher may be used. Any suitable concentration technique may be used. Block 110 indicates a number of alternative techniques that may be used to concentrate the filaments. These include vacuum evaporation (block 112), lyophilization (block 114), dialysis (block 116), PEG dessication (block 118) and other suitable concentration methods (block 119).

The filaments can be aligned to some degree, either prior to or during the step of forming the filaments into larger structures. It is desirable to at least partially align the filaments when forming larger structures so that in the resulting material, filaments are oriented preferentially in one or more preferred directions. The filaments need not all be aligned in the same direction and need not all be parallel to one another. A majority of the filaments should be aligned in one or more preferred directions. In some embodiments of the invention, alignment of the filaments may be performed during concentration of the filaments (block 119A). In other embodiments, the filaments may be aligned during formation of the filaments.

An alignment-promoting material may be added so that it is present while the filaments are being concentrated and/or formed into larger structures (block 119B). In some embodiments, the alignment-promoting material may comprise up to 5% of the total weight of the filaments. In other embodiments, the alignment-promoting material may comprise more than 5% of the total weight of the filaments. The alignment-promoting material may comprise one or more suitable proteins or peptides, for example. Several proteins have now been described that function as intermediate filament-bundling proteins. Filament-bundling proteins may be isolated from natural sources or obtained from recombinant sources. For example, the protein filaggrin, which bundles keratin intermediate filaments in skin, possesses an intermediate filament-bundling domain (see e.g. Mack, J. W. et al., *The mechanism of interaction of filaggrin with intermediate filaments: The ionic zipper hypothesis* J. Mol. Biol. 232: 50–66 (1993)). The family of cytolinker proteins possesses repeat domains that bind many types of cytoskeletal IFs and are most effective with type III IFs such as vimentin (see e.g. Steinbock F A, et al., *Dose-dependent linkage, assembly inhibition and disassembly of vimentin and cytokeratin* 5/14 *filaments through plectin's intermediate filament-binding domain*, J. Cell Sci. 113(3):483–491 (2000)). Various proteins and peptides having structures known to induce bundling in intermediate filament proteins, such as those that occur in filaggrin and hornerin in mammalian systems, may be used as alignment-promoting materials. Suitable custom peptides based on conserved IF binding sequences may also be used as alignment-promoting materials. Inorganic materials (e.g. metals which bind to and promote alignment of filaments) may also perform the function of promoting alignment of the filaments.

In some alternative embodiments, alignment and bundling of filaments are promoted by maintaining conditions which promote filament bundling prior to or during concentration of the filaments. It is known that several different factors can cause intermediate filament bundling. Ma et al., *A 'hot-spot' mutation alters the mechanical properties of keratinfilament networks*, Nat. Cell Biol. 3(5):503–506 (2001) demonstrate that IFs can be induced to bundle with only minor changes in buffer conditions such as a pH change from 7.4 to 7.0, a slight increase in ionic strength (by adding 10 mM NaCl), or by substituting phosphate buffer for Tris buffer. Therefore, altering pH (block 119C), altering ionic strength (block 119D), or altering buffer composition (block 119E) can also promote filament alignment and bundling.

The method may include steps directed to induce filament bundling. These steps may include appropriate selection of buffer conditions and/or introduction of alignment-promoting materials. In some embodiments, the alignment-promoting materials comprise one or more suitable materials selected from:

- proteins, such as
  - cytolinker proteins,
  - filaggrin
  - hornerin
  - proteins which include the intermediate filament-binding domain of filaggrin or hornerin;
  - compounds which include the intermediate filament binding groove of Plakins; and
- peptides based on conserved IF binding sequences
- metal ions;
- other organic or inorganic materials that promote bundling of the filaments.

In some embodiments, alignment-promoting materials or alignment-promoting conditions are introduced during block 90 (i.e. introduced with the starting materials) and/or block 100 (i.e. introduced during formation of filaments) to cause the filaments to form bundles in dilute suspension. The alignment-promoting materials or conditions may then simultaneously satisfy the functions of aligning the filaments and locally concentrating the filaments. Aligned filaments tend to form bundles of filaments. Bundling filaments into structures that possess tens to hundreds of filaments in a given cross-section will substantially increase the persistence length of the filaments and therefore make it easier to align them during assembly into larger structures, such as fibres, films, or bulk materials. In addition, the bundling of the filaments may facilitate removal of excess solvent during and subsequent to the concentration performed in block 110.

The filaments may also be aligned using other suitable alignment methods (block 119F). For example, filaments may be aligned under flow as described, for example, in *Silk Polymers: Materials Science and Biotechnology* (1994), which is incorporated herein by reference. The filaments may also be aligned by charge, by substrate directed alignment, or by any other suitable alignment technique.

Once concentrated, the α-helical filaments are formed into larger structures such as fibres, films, or bulk materials (block 120). This may be accomplished using any suitable spinning techniques. *The Encyclopedia of Polymer Science and Engineering* (1988), which is incorporated herein by reference, provides examples of various spinning techniques that may be used to form filaments into fibres or films.

At block 140, after being formed into fibres, films, or bulk materials, the α-helical filaments are extended. This may be done during the process of forming the fibres, films, or bulk materials or in a separate step. For example, fibre formation and stretching can simultaneously occur in cases where the α-helical filaments are subjected to significant shear and tensile forces as the fibre is extruded from fibre forming machinery. The filaments may also be extended after the fibres, films, or bulk materials are formed.

Stretching or extending may be done while the fibres, films, or bulk materials are dry as indicated by block 142 or when the fibres, films, or bulk materials are wet, as indicated at block 144. The degree of stretching may be varied to achieve desired material properties. The degree to which the fibres, films, or bulk materials can be stretched is limited by the breaking strength of the fibres, films, or bulk materials which, in turn, depends in part on the degree of alignment of the filaments which make up the fibre or film. Typically, when the stretching is performed on dry fibres, films, or bulk materials, the filaments are strained to a strain in the range of $\epsilon=0.025$ to $\epsilon=1.0$. When stretching is performed on wet fibres, films, or bulk materials, strains in excess of $\epsilon=0.35$ and ranging up to values which depend upon the breaking strain of the fibres, films, or bulk materials, but may be $\epsilon=1.6$ or more are preferred. The filaments may be strained once, or they may be strained by repeatedly applying and removing a load from the filaments. Any suitable mechanism may be used to strain the filaments.

Blocks 130 and 150 are optional. These blocks include steps to promote cross-linking between the proteins in the filaments which make up the fibres, films, or bulk materials. Some specific mechanisms that may be exploited to promote cross-linking of the proteins include UV exposure (block 132), treatment with glutaraldehyde (block 134), treatment with other types of radiation such as γ radiation (block 136), tanning, metal-coordination, and other methods for promoting cross-linking (block 138). Method 80 may include both of blocks 130 and 150, either one of blocks 130 and 150 or neither one of blocks 130 and 150. Blocks 130 and 150 may use the same or different ways to promote cross-linking.

The resulting fibres, films, or bulk materials can be used in manufacturing industrially useful materials (block 160). Some examples of materials which can be made using fibres, films, or bulk materials made according to the invention include, but are not limited to, textiles, biomedical devices, drug delivery vessels, tissue engineering substrates, biosensors, and electronic devices.

2.0 Production of α-Helical Protein Based Materials—α-Helical Filament Sources

Suitable IFs or IF-like filaments may be isolated from virtually all animal cells (Matoltsy, 1965), plants (for example, carrots (Masuda et al., 1997)), and fungi (for example, yeast (Jannatipour and Rokeach, 1998)).

The filament-forming α-helical protein starting materials may comprise any suitable proteins capable of forming filaments. In one embodiment, the filament-forming α-helical proteins form IFs which meet the criteria outlined in the specification below. In a specific embodiment, the filament-forming α-helical proteins are the protein constituents of hagfish slime threads.

Suitable filament-forming α-helical proteins may be recombinantly generated by a variety of in vitro or in vivo expression systems. The vectors can be transformed into hosts, such as bacteria (for example: *Escherichia coli*), eukaryotic organisms (for example: yeast) or mammalian cell lines. In vivo expression systems may use transgenic organisms (for example: goats (http://nexiabiotech.com) and plants such as tobacco and potatoes (Scheller et al., 2001 and Pandey, 2001)) that have been genetically engineered to facilitate the production and isolation of suitable filament-forming α-helical proteins in usable purities and quantities. The proteins can be isolated from the hosts and purified. The genes which code for hagfish slime thread proteins have been sequenced (see Kouth et al. 1994, 1995) and these gene sequences may be used to produce hagfish slime thread proteins by recombinant methods.

Suitable filament-forming α-helical proteins may also be produced chemically (for example, using standard peptide synthesis protocols or by using any solution or substrate based peptide synthesis methods), or with cell free translation methods.

The filament-forming α-helical proteins should be provided in reasonably pure form to facilitate self-assembly of filaments and spinning of fibres or films from such filaments. Any standard or modified purification protocols may be employed to purify the proteins. The best method to use will depend on the protein source—for example see Lazaris et al. (2002) compared to Scheller et al. (2001).

Self-Assembly of α-Helically Coiled Protein Filaments

In preferred embodiments of the invention, the starting materials are permitted to self-assemble to form filaments.

As described above, the filament-forming α-helical proteins may comprise the protein constituents of one or more IFs. IF proteins can self-assemble at appropriate pH, temperature, ionic strength, and concentration of metal chelators and/or reducing agents (for examples see Hargreaves et al. (1998), Abumuhor et al. (1998), Cerda et al. (1998), Fradette et al. (1998), Herrmann et al. (2000), Herrmann et al. (1999), Porter et al. (1998), Spitzer et al. (1984), Spitzer et al. (1988), Wang et al. (2000), Wu et al. (2000) and Yoon et al. (2000)). In some embodiments of the invention, once isolated, the filament-forming α-helical proteins are allowed to self-assemble into α-helical filaments. IF proteins are particularly useful in such embodiments of the invention.

Concentration of α-Helically Coiled Protein Filaments

To produce useful materials from the α-helical filaments, a concentration step may be required. The starting concentration of α-helical filaments produced by self-assembly of filament-forming α-helical proteins may be in the range of about 0.05 to 2 mg/ml. As described above, the α-helical filaments may be concentrated by any suitable methods to concentrations suitable for forming fibres, films, or bulk materials. Such concentrations typically range from about 0.5 mg/ml to 100 mg/ml. The α-helical filaments may be lyophilized and then brought to concentrations in the ~0.5 mg/ml to 100 mg/ml range in aqueous solvents (for example: water, phosphate buffered saline etc.). The concentrated α-helical filaments may be spun directly into fibres or used to make IF based gels, liquid crystals for forming fibres, films, or bulk materials.

Alignment of Filaments

As discussed above, the filaments can be aligned to some degree, either prior to or during the step of forming the filaments into larger structures. In some embodiments of the invention, alignment of the filaments may be performed during concentration of the filaments. In other embodiments, the filaments may be aligned during formation of the filaments.

The filaments may be aligned in a number of different ways. An alignment-promoting material may be added so that it is present while the filaments are being concentrated and/or formed into larger structures. The alignment-promoting materials may comprise any organic or inorganic material that promotes filament alignment or bundling. The alignment-promoting material may comprise one or more suitable proteins or peptides. Such proteins include filament-bundling proteins, which may be isolated from natural sources or obtained from recombinant sources. The peptides may contain conserved sequences or functional domains from known filament-bundling proteins. The alignment-promoting materials may also include metals which facilitate filament alignment or bundling. The filaments may also be encouraged to align through changes in pH, changes in ionic strength of buffer, and changes in buffer composition.

In some embodiments, the alignment-promoting materials are introduced with the starting materials. In a specific embodiment, alignment-promoting materials can be incorporated into the source of the filament-forming proteins. For example, a recombinant vector containing a gene for a filament-forming protein may also include a gene for an alignment-promoting material, such as a filament-bundling protein or peptide. In other embodiments, the alignment-promoting materials can be introduced during formation of filaments, to cause the filaments to form bundles in dilute suspension. Alignment and bundling of the filaments may facilitate assembly of the filaments into larger structures, such as fibres, films, or bulk materials. The larger structures may have tens or hundreds of filaments in a given cross section. In addition, the bundling of the filaments may facilitate removal of excess solvent during and subsequent to concentration of the filaments.

The filaments may also be aligned under flow as described, for example, in *Silk Polymers: Materials Science and Biotechnology* (1994). The filaments may also be aligned by charge, by substrate directed alignment, or by any other suitable alignment technique.

As discussed above, it is desirable to at least partially align the filaments when forming the fibres, films, or bulk materials so that in the resulting material, filaments are oriented preferentially in one or more preferred directions. The filaments need not all be aligned in the same direction and need not all be parallel to one another. A majority of the filaments should be aligned in one or more preferred directions.

Fibre Spinning and Film Production

α-helical filaments may be spun into fibres or used to form films or bulk materials directly from suitable concentrated solutions, gels, or liquid-crystals.

The filaments may be spun directly into fibres through an orifice using conventional spinning technologies as described, for example, in *The Encyclopedia of Polymer Science and Engineering* where it is shown that fibres may be spun in air, vacuum, gas, under electrical charge and/or wet-spun into a coagulation bath such as methanol. Typical spinning speeds may range from, but are not limited to, 0.5–40 cm/sec.

Suitably concentrated solutions, gels or liquid-crystals of α-helical filaments may also be converted into ultra-thin (<100 nm) or thin (100 to 10,000 nm) films by standard techniques, for example: shear between two plates, spin casting, substrate directed deposition, the formation of Langmuir-Blodgett multi-layers, alternating polyanion-polycation deposition or a variety of surface grafting methods (a summary of these methods can be found in *Science* Vol. 273, 1996 pp. 841–1016). The films may also be deposited epitaxially.

Suitably concentrated solutions, gels or liquid-crystals of α-helical filaments and previously formed fibres or films may also be formed into bulk materials, including, but not limited to, rods, sheets, cords, strips, etc.

Modulating the Mechanical Properties of α-Helical Protein Based Materials

The fibres or films produced by methods according to the invention may be processed further to achieve improved mechanical properties. The following are examples of processing steps that may be used alone or in conjunction to modulate the mechanical properties of the material.

Draw Processing

The α-helical structures contained within the α-helical protein based materials of this invention can be converted from their native state to a β-sheet conformation. This process usually involves crystallization of protein chains in the extended chain conformation and provides improved strength, stiffness and/or toughness while reducing extensibility. The conversion is achieved by drawing the fibre or film in the dry or wet state (in aqueous and/or organic solvents) to draw ratios ranging between, but not limited to ~0 and 500%, depending on the degree of alignment of the α-helical filaments, the hydration state and/or the solvent used to hydrate the fibre, film, or bulk material.

The amount of strain which should be applied to the fibre, film, or bulk material depends on the intended use for the fibre, film, or bulk material. The fibre, film, or bulk material can be strained by applying a load. Alternatively, the fibre or film can be strained by repeatedly applying a load, then removing the load from the fibre or film a desired elongation has been achieved. The fibre, film, or bulk material can be strained during the fibre spinning or film or bulk material formation process, or they can be strained after the fibre, film, or bulk material formation process. Any suitable draw processing technology may be used to subject the filaments to strain. Some known draw processing methods are described in The Encyclopedia of Polymer Science and Engineering (1988).

Cross-Linking

The material properties of fibres or films of α-helical filaments may be modulated by standard non-specific cross-linking of the IF-based materials with glutaraldahyde, UV, γ-irradiation, tanning (for examples see *The Encyclopedia of Polymer Science and Engineering,* 1988), by the cross-linking of specific amino acids such as cysteine, lysine, and tyrosine (for example see Capello (1998), Stedronsky et al. (2000) and Duckler et al. (1971)), and/or by the co-ordination of metals, such as calcium, iron, zinc, copper, etc. Metals may be co-ordinated through metal binding domains in the sequences of the filament-forming α-helical proteins, for example through histidines which bind metals such as copper and/or zinc. Globular domains of the filament-forming α-helical proteins could be modified to contain such metal binding sites. Cross-linking increases the stiffness and decrease the extensibility of α-helical filaments. Depending on the particular application, cross-linking may be used to optimize the stiffness and toughness of an IF-based material.

Plasticizers

Plasticizers may be introduced at any stage of the proposed process. Examples of polymeric plasticizers are given in *The Encyclopedia of Polymer Science and Engineering* (1988). Again, depending on the particular application, the amount of plasticizer added may be adjusted and optimized to achieve desired material properties.

Uses of α-Helical Protein Based Materials

Fibres, films or bulk materials according to the invention may be applied in a wide variety of industrial settings. For example, such materials may be used in making textiles (for example: as clothing and as high performance fibres for sporting goods and anti-ballistic applications), in biomedicine (for example: as sutures, as drug delivery vessels, as tissue engineering substrates and as bio-sensors), and potentially in the electronics industry (for example: as components of transducers or as substrates for making metal-doped nano-wires).

3.0 Specific Embodiments of α-Helical Filaments 3.1 Intermediate Filaments

IFs are a specific group of α-helical filaments which may be used in this invention. IFs are a diverse group of intracellular filaments that are found within most animal cells. IFs make up a significant portion of the cytoskeleton in living cells (Alberts, 1994), and have been shown to impart cells with mechanical integrity (Fuchs and Cleveland, 1998; Wang and Stamenovic, 2000). IFs are especially abundant in α-keratins such as hair, nail, and horn, where they make up the fibrous component of these tough bio-composites. IFs can be sub-classified into six different types. Type I IFs (acidic keratins) and Type II IFs (basic keratins) are known as the keratin IFs. Type III IFs comprise vimentin, desmin, glial fibrillary acidic protein, and peripherin. Type IV IFs comprise neurofilaments. Type V IFs comprise nuclear lamins. Type VI IFs comprise nestin, synemin, and paranemin.

IFs are made of IF proteins. Over 200 IF proteins from a variety of species have been sequenced to date (Parry and Steinert, 1999), with over 50 IF proteins identified from humans (Fuchs and Cleveland, 1998).

There are several characteristics common to all IF proteins. IF proteins exhibit a tripartite domain structure, with a central α-helical rod domain flanked by non-helical N- and C-terminal domains. The rod domains exhibit a strong heptad repeat structure of the form:

$$(a\text{-}b\text{-}c\text{-}d\text{-}e\text{-}f\text{-}g)_n$$

where a and d are most often apolar residues such as leucine, valine, or isoleucine, and residues e and g are often charged. The central rod domain contains between 310 and 357 residues with heptad repeats occurring over the majority of the length of the domain. However, the heptad pattern is not continuous over the entire length of the domain. Three non-helical "linker" regions (LI, LI2, and L2) occur between four heptad repeat regions (1A, 1B, 2A, 2B). Region 2B contains a characteristic "stutter" in one of its heptad repeats in which three residues are missing. At the beginning of region 1A is a conserved region known as the "helix initiation motif," and at the end of region 2B is a similarly conserved "helix termination motif" (Parry and Steinert, 1999).

The terminal domains that flank the central rod domain are not nearly as well conserved, but homologies have been identified among the keratin IFs. Adjacent to the beginning of region 1A and the end of region 2B are highly conserved non-helical regions known as H1 and H2, respectively. Adjacent to regions H1 and H2 are hyper-variable regions V1 and V2, which are not only variable among IFs, but often exhibit allelic variability at a single gene locus. It is likely that the sequence and size of regions V1 and V2 can be altered without serious consequences for IF assembly or integrity. Regions E1 and E2 occur at the extreme ends of IF protein chains and are generally short and basic.

IF protein chains are known to form coiled-coil helical dimers because of the presence of heptad repeats in the central rod domain. This is due to the presence of the hydrophobic apolar residues in the heptad repeats. To limit contact with water, the apolar residues of one chain interact hydrophobically with the apolar residues of another chain. This in turn stabilizes the helix structure. The dimers are believed to associate into anti-parallel tetramers, which link end to end and form protofilaments. Protofilaments are believed to wind around one another to form protofibrils, and four protofibrils may wrap around each other to form filaments approximately 10 nm in diameter. Typical IFs found in cells are 10 to 20 μm in length. IFs having lengths in the range of 100 nm to 100 μm or greater may be generated. Under appropriate in vitro conditions, solubilized IF proteins self-assemble into IF filaments.

Figure 2:
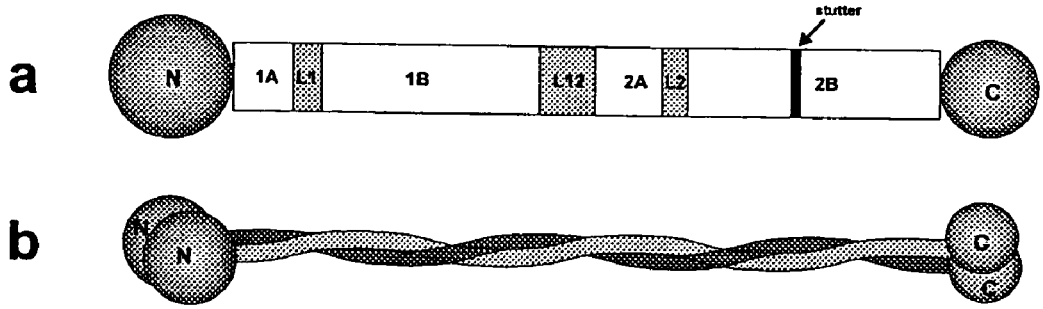
FIG. 2 is a diagram of conserved regions of intermediate filament proteins.

FIG. 2(*a*) illustrates the structure of a typical IF protein. As shown in (a), the IF protein comprises a central rod domain containing four regions of heptad repeats (regions 1A, 1B, 2A, 2B), which are interrupted in three conserved locations by linker sequences L1, L12, and L2. Region 2B contains a conserved "stutter" in which three residues are missing from a complete heptad. FIG. 2(*b*) shows a typical IF protein dimer. The heptad repeat structure of the central rod domain results in the formation of IF protein dimers, in which two central rods wrap around one another in a coiled-coil stabilized by hydrophobic interactions.

Parry and Steinert (1999) point to seven criteria that can be used to ascertain whether a given protein can be classified as an IF protein. According to these criteria, all IF proteins possess:

1. Four heptad containing coiled-coil segments corresponding in length to regions:
   a. 1A (35 residues);
   b. 1B (101 or 143 residues):
   c. 2A (19 residues); and
   d. 2B (121 residues).
2. A linker segment, L2, with a length of 8 residues.
3. Two conserved motifs:
   a. Helix initiation motif (at the beginning of region 1A); and
   b. Helix termination motif (at the end of region 2B).
4. A common period in the linear distribution of acidic and basic residues.
5. A phase discontinuity in the heptad repeat in the middle of segment 2B.
6. An ability to form filaments of 10–15 nm diameter.
7. A level of homology with other IF proteins that lies well in excess of that shown by heptad containing regions in other α-fibrous proteins such as tropomyosin.

A person skilled in the art will appreciate that IF proteins are united not only by sequence homology but also by patterns of hydrophobicity in their amino acid sequences. Therefore, for the purposes of this disclosure and the appended claims, the term "intermediate filament proteins" (abbreviated herein as "IF proteins") includes proteins that fall under Parry and Steinert's classification (i.e. all proteins classified as IFs now and in the future), as well as proteins which constitute modifications of known IF protein sequences that retain the ability to form filaments in vitro of the size range 7–16 nm in diameter. Such modifications may include, but are not limited to:

Conservative mutations in any part of the sequence in which a residue is replaced by one of similar size and polarity (e.g. leucine for isoleucine).

An increase or decrease in the size of the central rod domain via the addition or deletion of heptad repeats.

An increase or decrease in the size and/or sequence of the terminal domains, especially regions V1 and V2.

An increase or decrease in the cysteine content of the proteins to either facilitate or hinder intra- or inter-chain disulfide cross-linking.

In this disclosure and the appended claims, the term "intermediate filament" (abbreviated herein as "IF") includes any filament made from IF proteins, as defined above.

3.2 Hagfish Slime Threads

Figure 3:
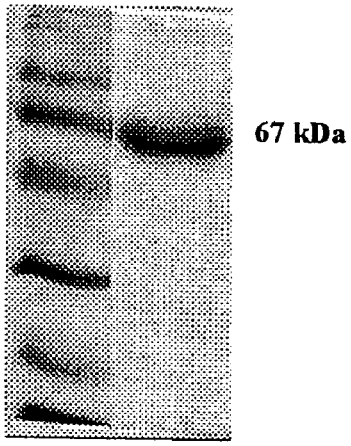
FIG. 3 is an SDS-PAGE of isolated hagfish slime thread solubilized in 10M urea, in which the left lane contains molecular weight markers.

In a further specific embodiment of the invention, the filament-forming α-helical proteins comprise hagfish slime thread proteins and the IFs comprise hagfish slime thread IFs, specifically threads of the type which can be isolated from the slime of Pacific hagfish species *Eptatretus stoutii*. Hagfishes have the ability to produce vast amounts of fibre-reinforced defensive slime. The threads that reinforce the slime (hereafter referred to as "slime threads") are manufactured within specialized cells called thread cells that grow and mature within the slime glands of hagfishes (Downing, 1981; Fernholm, 1981). Each thread cell produces a single, continuous, intricately coiled thread. When the thread cell is ejected from the slime gland, the plasma membrane of the thread cell erupts, and the slime thread unravels. Each thread is approximately 1 to 3 μm in diameter and 10 to 17 cm in length. Slime threads are composed almost exclusively of IFs. FIG. 3 is an SDS-PAGE of a slime thread solubilized in 10 M urea. The slime thread IFs appear to be composed almost entirely of 67 kDa IF proteins.

3.3 Other Filaments

Other filaments may also be used in the practice of the invention. For example, α-helix containing filaments formed from single folded protein molecules could be used.

Mechanical Properties of Hydrated Slime Threads

Figure 4:
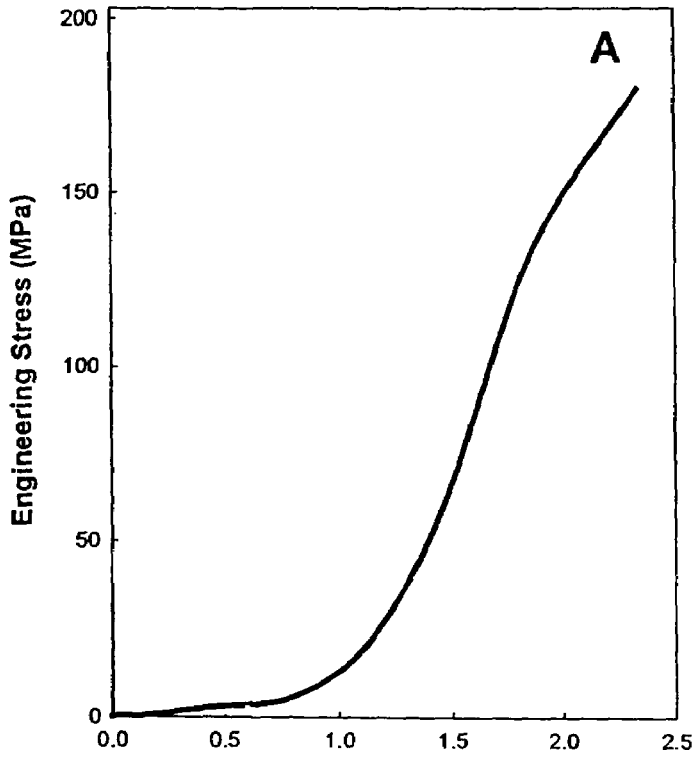
FIG. 4 is a curve depicting the mechanical behaviour of a hydrated slime thread.

Although slime threads are composed almost exclusively of keratin-like IFs, the properties of the threads as they function in the slime are different from the properties of keratins such as nail, hair, quill, and horn. Whereas keratin structures exhibit a high initial stiffness ($E_i$=2 GPa) and modest extensibility ($\epsilon_{max}$=0.5), slime threads in water exhibit a low initial stiffness ($E_i$=6.4 MPa) and high extensibility ($\epsilon_{max}$=2.2) (Table 1). FIG. 4 depicts a stress-strain curve of a hydrated slime thread. Native slime threads in water show strain hardening, with ultimate stresses comparable to those for keratins.

TABLE 1

Mechanical properties of hagfish slime threads in seawater. Values are mean ± SE. Sample sizes are in parentheses.

| $E_i$ (MPa) | Yield ϵ ($\Delta L/L_o$) | Yield σ (MPa) | Max ϵ ($\Delta L/L_o$) | Strength (MPa) | Toughness ($MJ/m^3$) |
|---|---|---|---|---|---|
| 6.4 ± 0.9 (8) | 0.34 ± 0.01 (12) | 3.2 ± 0.4 (12) | 2.2 ± 0.2 (14) | 180 ± 20 (9) | 130 ± 20 (9) |

Figure 5:
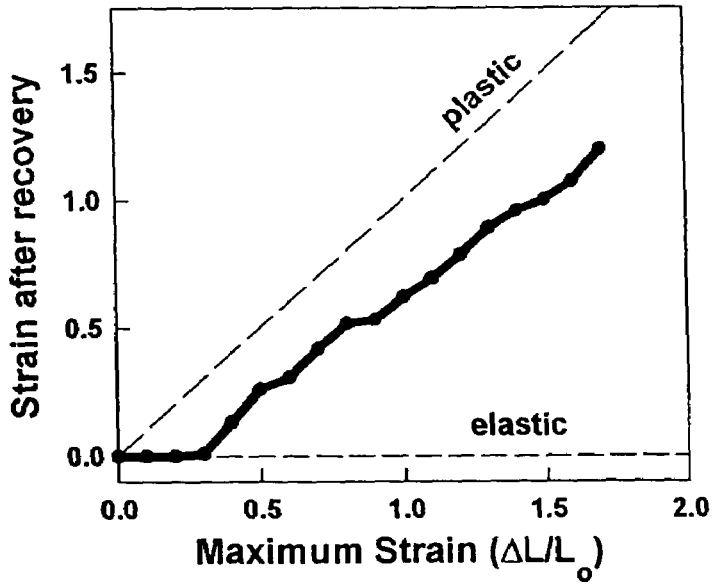
FIG. 5 is a strain recovery curve of a hydrated slime thread.

While the inventors do not wish to be bound by any particular theory of operation, it is believed that the low $E_i$ can be attributed to soft, elastomeric terminal domains in series with stiff central rod domains. Strain recovery experiments with hydrated slime threads demonstrate that elastomeric behavior dominates at strains up to ϵ=0.35, with deformation being reversible in this range (see FIG. 5). At strains greater than 0.35, deformation becomes primarily irreversible, or plastic, due to the extension of α-helices into β-sheets in the central rod domains. At strains greater than 1.0, β-sheet crystal content (and therefore stiffness) is at its highest, and the stiffness remains relatively constant until failure at a strain of about 2.2.

Congo red staining experiments demonstrate that the β-sheet content of the threads increases between strains of 0.35 and 1.0. Congo red is a dye which can be used to detect amyloid fibres. The dye creates an apple-green birefringence when it interacts with β-sheets. At strain values less than 0.35, slime threads stained with congo red appeared grossly swollen and lose their mechanical integrity. At strain values greater than 0.35, slime threads retained their mechanical integrity and displayed increasing metachromasia with increasing strain. At $\epsilon$=0.35, the threads appeared orange-yellow. At $\epsilon$=0.50, the threads appeared green. At $\epsilon$=0.75, the threads appeared blue. At $\epsilon$=1.0, the threads appeared blue-violet, and at $\epsilon$=1.5, the threads appeared magenta to colourless.

Figures 6A, 6B, 6C:
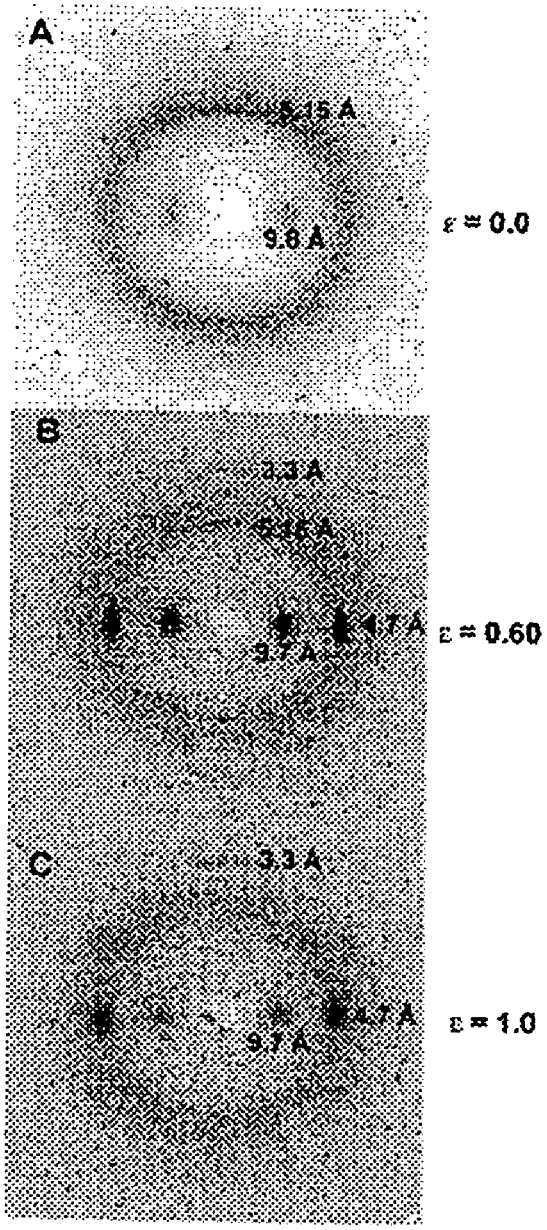
FIG. 6A depicts the an X-ray diffraction pattern of a bundle of unstrained slime threads.
FIG. 6B depicts the X-ray diffraction pattern of a bundle of slime threads extended to a strain of 0.6.
FIG. 6C depicts the X-ray diffraction pattern of a bundle of slime threads extended to a strain of 1.0.

X-ray diffraction patterns also demonstrate that the β-sheet content of the threads increases between strains of 0.35 and 1.0. As shown in FIG. 6A, unstrained slime threads display a typical α-helix X-ray diffraction pattern. In FIG. 6C, at a strain of 1.0, slime threads display a typical β-sheet crystal X-ray diffraction pattern. At a strain of 0.6, slime threads display a mixed X-ray diffraction pattern (FIG. 6B).

α-keratins are also capable of undergoing an α-to-β transition in which the IF α-helices are extended into β-sheets forms (Fraser et al., 1969). α-keratins, such as in hair, nail, and quill normally substantially comprise α-helical proteins in their natural state. Little, if any of the proteins in keratins are in a β-sheet structure in their natural state. In these materials, the α-to-β transition is reversible (Hearle, 2000), presumably due to the cross-linked matrix of keratin-associated proteins that function in parallel with the IFs and provide a restoring force that eventually restores the α-helices. In slime threads, the α-to-β transition also leads to the formation of β-sheet crystals that then constitute the rigid reinforcing components of a supra-molecular polymer network. In the absence of a protein matrix, this process is essentially irreversible. A person skilled in the art will understand that many other α-helix containing filaments, including other IFs, that are also substantially free of protein matrices, will also undergo irreversible α-to-β transitions when stretched.

Mechanical Properties of Dry Slime Threads

Figure 7:
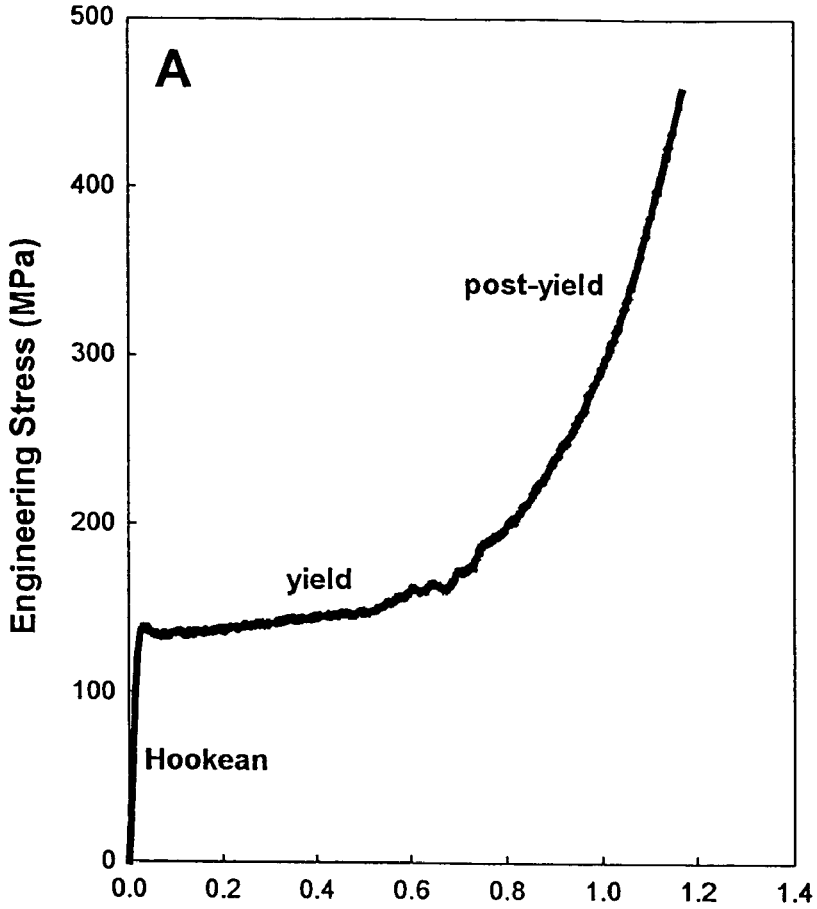
FIG. 7 is a stress-strain curve depicting the mechanical behaviour of a dry slime thread.

Dry slime threads have a very high $E_i$ (about 8 GPa), and yield at a strain of about 0.025 into a long, low modulus plateau region that continues to a strain of about 0.8 (see Table 2). At the end of the plateau, stiffness rises moderately to failure at a strain of about 1.0 (see FIG. 7). The main differences between these properties and the properties of keratins are that $E_i$ is higher in slime threads, and the α-to-β transition (which correlates with the plateau zone) occurs over a strain range about twice as long. Dry slime threads are also stronger than keratins. These differences can be attributed to the absence of a (relatively weak) cross-linked matrix in slime threads, which in keratins tends to dilute the strength and stiffness of the IFs.

TABLE 2

Mechanical properties of dry hagfish slime threads. Values are mean ± SE. Sample size is in parentheses. $\epsilon$ = strain, $\sigma$ = stress.

| $E_i$ (MPa) | Yield $\epsilon$ (ΔL/Lo) | Yield $\sigma$ (MPa) | Ultimate $\epsilon$ | Strength (MPa) | Toughness (MJ/m$^3$) |
|---|---|---|---|---|---|
| 7700 ± 500 (7) | 0.024 ± 0.001 (13) | 150 ± 10 (7) | 1.0 ± 0.1 (13) | 530 ± 40 (7) | 240 ± 20 (7) |

Mechanical Properties of Draw-Processed Slime Threads

The inventors have discovered that draw-processing fibres films, or bulk materials of α-helical filaments that lack an associated protein matrix produces fibres, films, or bulk materials that are stiff, strong, and, depending on the degree of processing, very tough. An example of α-helical filaments which can be used to create such fibres, films, or bulk materials is hagfish slime thread IFs. The draw processing may be performed in air.

Figure 8:
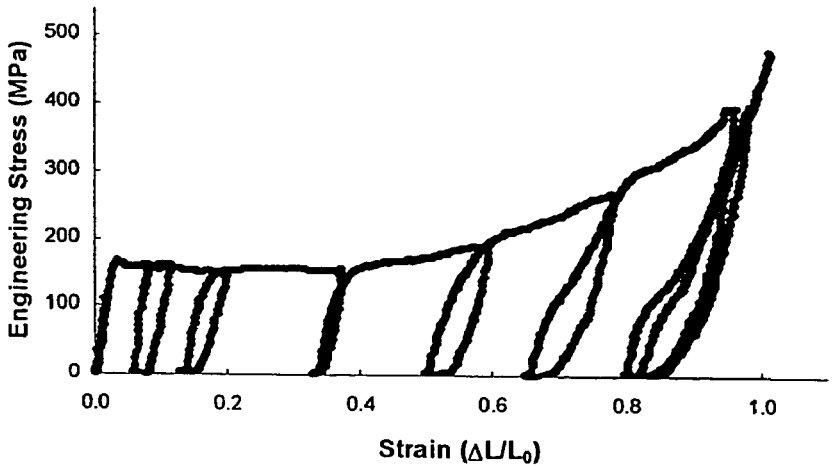
FIG. 8 is a stress-strain curve depicting the mechanical behaviour of a dry slime thread subjected to multiple cycles of loading and unloading.
Figure 9:
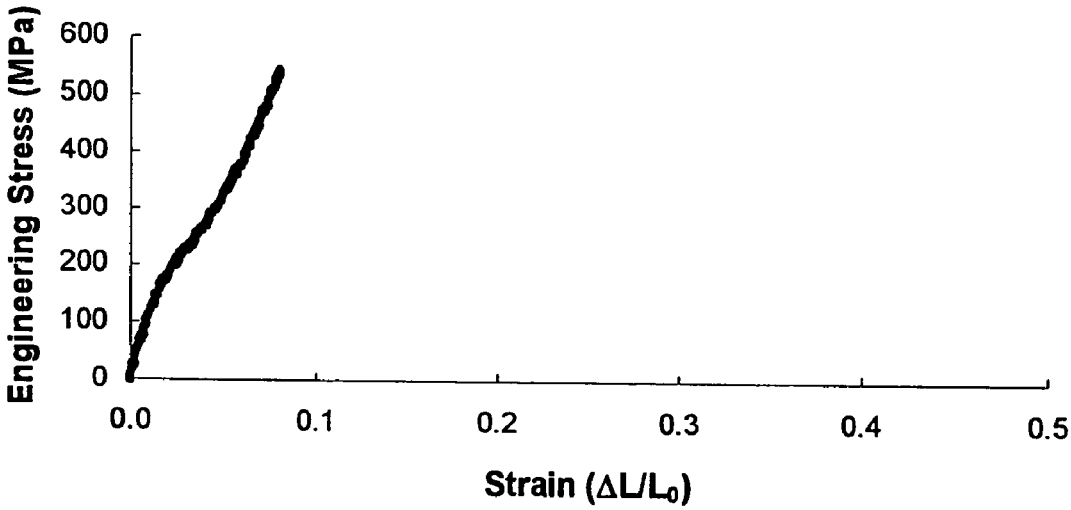
FIG. 9 is a stress-strain curve of a dry slime thread after draw-processing in air to a strain of 1.0.

Because the α-to-β transition in slime threads and other suitable proteins is effectively permanent, draw processing results in a stiff, strong fibre dominated by β-sheet structure. This phenomenon is best illustrated by a series of mechanical load cycles in which a slime thread in air is loaded and unloaded incrementally to failure. As shown in FIG. 8, at the beginning of the trial, the thread behaves simply like a slime thread in air, but as the cycles progress, β-sheet content increases, ultimately leading to a stiff and strong fibre with only about 1/10 of its original extensibility, as illustrated in FIG. 9. These draw-processed fibres have impressive properties for biological polymers, with an initial stiffness of about 10 GPa, and a strength of about 600 MPa.

Figure 10:
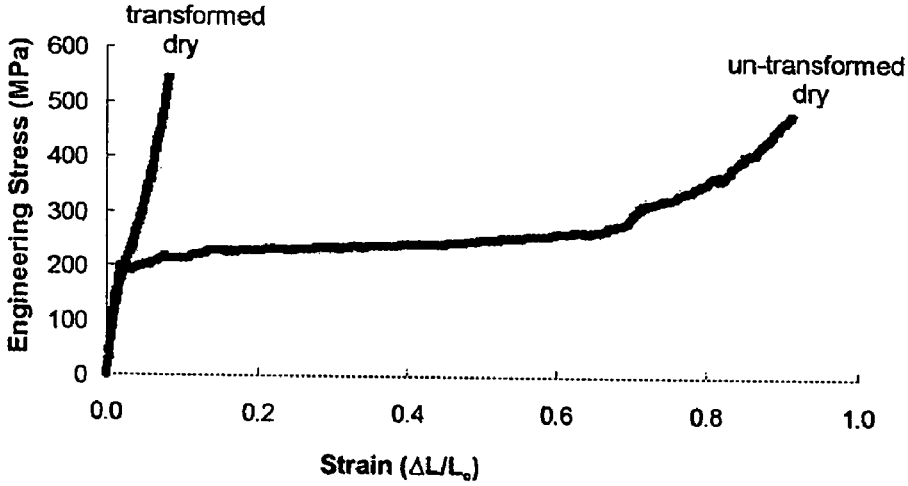
FIG. 10 is graph comparing the stress-strain curves of an unprocessed dry slime thread and a draw processed dry slime thread processed to a strain of 1.0.

FIG. 10 compares the stress-strain curves of two different slime threads. One slime thread was tested after drying only. The other was draw-processed to a strain of 1.0 before testing. The curves indicate that unprocessed threads possess greater extensibility and toughness, while the processed threads possess high stiffness and strength. Slime threads with intermediate properties could be produced by partial processing. Such an approach could be used to optimize stiffness and toughness for particular applications.

4.0 Specific Embodiment of a Method for the Production of α-Helical Protein Based Materials In a specific embodiment, the filament-forming α-helical protein starting materials are obtained by isolating slime threads from Pacific hagfish species *Eptatretus stoutii*. Alternatively, slime thread proteins may be recombinantly generated by a variety of in vitro or in vivo expression systems. Because hagfish slime thread protein encoding genes are neither large nor problematically repetitive, expression of these proteins does not pose the same challenges that expression of spider drag-line protein genes do.

The hagfish slime thread proteins may also be produced chemically (for example, using standard peptide synthesis protocols or by using any solution or substrate based peptide synthesis methods), or with cell free translation methods, as described above.

The hagfish slime thread proteins should be reasonably pure to facilitate self-assembly into filaments and spinning of the filaments into fibres or forming films or bulk materials to make materials according to the invention. Any standard or modified purification protocols may be employed.

Self-Assembly of Hagfish Slime Thread Proteins into Intermediate Filaments

As described above, IF proteins self-assemble at appropriate pH, temperature, ionic strength, and concentration of metal chelators and/or reducing agents. Therefore, under appropriate conditions, recombinantly produced hagfish slime thread proteins self-assemble into IFs.

Concentration of Hagfish Slime Threads

To produce useful materials from hagfish slime threads, a concentration step may be required. Self-assembled slime thread IFs at starting concentrations ranging between ~0.05 and 0.8 mg/ml are concentrated by standard methods, as described above, to concentrations ranging from ~0.5 mg/ml to 100 mg/ml, or lyophilized and then brought to concentrations in the ~0.5 mg/ml to 100 mg/ml range in aqueous solvents (for example: water, phosphate buffered saline etc.). The concentrated slime threads are then spun directly into fibres or used to make filament based gels and/or liquid crystals.

Alignment of Hagfish Slime Thread IFs

It is desirable to align the filaments in the slime thread solutions, gels, or liquid-crystals when forming the fibres, films, or bulk materials. Alignment of the filaments in the fibres, films, or bulk materials facilitates draw processing as described below. The filaments need not all be parallel to one another. A majority of the filaments should be aligned in one or more preferred directions. The filaments may be aligned in various ways including those described above.

As discussed above, the hagfish slime thread IFs can be aligned prior to assembly into materials such as fibres, films, or bulk materials. The hagfish slime thread IFs can be aligned by adding alignment-promoting materials, or by altering the pH, ionic strength, or composition of buffers during self-assembly or concentration of the hagfish slime thread IFs. Alternatively, alignment-promoting materials may be recombinantly produced along with recombinant hagfish slime thread IFs.

The filaments may also be aligned under flow as described, for example, in *Silk Polymers: Materials Science and Biotechnology* (1994). The filaments may also be aligned by charge, by substrate directed alignment, or by any other suitable alignment technique.

Fibre Spinning and Film Production

Concentrated slime thread IF solutions, gels, or liquid-crystals are then either initially aligned under flow or spun directly into fibres through an orifice using suitable spinning technologies as described above. The concentrated slime thread solutions, gels or liquid-crystals may also be converted into ultra-thin (<100 nm) or thin (100 to 10000 nm) films by standard techniques as described above. They may also be formed into bulk materials as described above.

Modulating the Mechanical Properties of IF Based Materials

The fibres, films, or bulk materials produced with the proposed method may either be used directly, or processed further to achieve improved mechanical properties. Included are examples that may be used alone or in conjunction to modulate the mechanical properties of the material.

Draw Processing

Slime thread fibres, films, and bulk materials may be draw processed by drawing the material in the dry or wet state (in aqueous and/or organic solvents) to draw ratios ranging between, but not limited to ~0 and 500%, depending on the degree of IF alignment, the hydration state and the solvent used to hydrate the fibres, films, and bulk materials.

In one embodiment, the slime thread fibres, films, and bulk materials are dried and strained to a strain between $\epsilon$=0.025 and $\epsilon$=1.0. In another embodiment the fibres, films, and bulk materials are stretched while wet to a strain greater than $\epsilon$=0.35. The strain applied alters the mechanical properties of the fibres, films, and bulk materials. The amount of strain to which the fibres, films, and bulk materials are subjected can be selected depending upon the intended use for the fibres, films, and bulk materials. The fibres, films, and bulk materials can be strained by applying a load to the fibres, films, and bulk materials. Alternatively, the fibres, films, and bulk materials can be strained by repeatedly applying the load, and removing the load until the fibres, films, and bulk materials are subjected to a desired strain. The fibres, films, and bulk materials can be strained during the fibre spinning or film and bulk material forming process, or they can be strained after the fibres, films, and bulk materials are formed.

In contrast to drag-line silk proteins, which supercontract in distilled water, draw-processed slime threads do not supercontract. They decrease in length by only 8% when swollen in distilled water, and it is likely that this value can be decreased by light cross-linking following draw-processing.

Cross-Linking

As described above, slime thread fibres or films may also be cross-linked. Cross-linking would increase the stiffness and decrease the extensibility of slime thread proteins. Depending on the particular application, cross-linking could be used to optimize the stiffness and toughness of a slime thread fibre material.

Plasticizers

Plasticizers may be introduced at any stage of the proposed process. Examples of polymeric plasticizers are given in *The Encyclopedia of Polymer Science and Engineering* (1988). Again, depending on the particular application, the amount of plasticizer added could be adjusted and optimized.

Uses of Slime Thread Based Materials

Materials generated with the proposed process may be used in the textiles industry (for example: as clothing, as high performance fibres for sporting goods, anti-ballistic applications or other applications where high performance materials are required), in biomedicine (for example: as sutures, as drug delivery vessels, as tissue engineering substrates and as bio-sensors), and potentially in the electronics industry (for example: as mechano-tranducers or as metal-doped nano-wires).

5.0 Examples 5.1 Mechanical Testing of Hydrated Slime Threads

Slime threads were isolated from Pacific hagfish (*Eptatretus stoutii*). Tensile properties of slime threads were measured using a modification of a glass microbeam force transducer apparatus as described in (Pollak, 1991). The technique is based on the premise that extremely small tensile forces can be measured by attaching a test sample to a fine glass microbeam and monitoring the bending of the beam under a microscope as the sample is deformed. Deflections of the beam can be converted to force values using an equation derived from beam theory:

$$F = \frac{3dEI}{l^3} \tag{1}$$

where F is the force, d is the deflection of the beam, E is the Young's modulus of glass, I is the second moment of area of the beam, and 1 is the length of the beam. The linear relationship between force and deflection holds for beam deflections up to about 10% of the length, and for this reason glass microbeams were chosen so that the maximum deflection during a test was typically only 1% of the length (200 μm deflection for a 20 mm beam).

The Young's modulus of the microbeams was not measured directly, but rather using larger glass rods from which the microbeams were pulled. Glass rods of diameter 3 mm and length 50 cm were mounted horizontally in the jaws of a vise, masses hung from their ends, and the deflection measured using a mounted ruler. From the glass rod radius, length, and deflection under a given load, the elastic modulus was calculated from beam theory to be $5.72\pm0.06\times10^{10}$ $N/m^2$.

The length of the glass microbeams (i.e. the distance from its base to the point of attachment of the slime thread) were measured after each test to the nearest 0.02 mm using calipers. Microbeam diameter was measured to the nearest m at the base and point of thread attachment eight times using a 15× filar micrometer eyepiece and 10× objective on a Wild™ compound microscope.

Individual stabilized thread cells were transferred to a seawater-filled glass-bottomed micromechanical chamber using a sharpened toothpick. Thread cells were allowed to partially unravel, and a 10 mm segment was mounted at one end to the glass microbeam (diameter=50–125 μm (depending on the nature of the mechanical test), length≈15 mm), and at the other to a sliding glass platform that could be moved in either direction by turning a micrometer knob. To secure threads to the microbeam, they were first wrapped around it approximately 10 times, and then fixed in place using a small amount of Cenco™Softseal TackiWax™(Central Scientific Company, Chicago, Ill.) applied with a fine needle. At the other end, threads were embedded in a 1 mm slab of TackiWax™ mounted on the sliding glass platform.

Threads were extended (strain rate=0.017 $s^{-1}\pm0.0006$ (SE)) by coupling the micrometer knob to a 72-rpm motor via a flexible belt. Force was measured by monitoring the bending of the glass microbeam with a video camera mounted on a Wild light microscope using a low power (4×) objective. Deflection of the microbeam was quantified using a video dimension analyzer (VDA model 303, Instrumentation for Physiology and Medicine, San Diego), and voltage output from the VDA was collected at 20 Hz using a National Instruments™DaqPad™4060E input/output board and LabView™v. 5 data collection software. Strain (change in length/resting length) was calculated from the time field using a calibration of the translation speed of the micrometer/motor set up and the resting length of the mounted thread, which was measured with calipers. The strain value inferred from the time field was corrected for the deflection of the microbeam by subtracting the deflection from the distance traveled by the traveler arm. The voltage output of the VDA was calibrated against a Bausch and Lomb™calibration slide with 0.1 mm increments. The slope of the voltage vs. length calibration curve was 10.68 V/mm, with an $r^2$ value of 0.9998.

5.2 Mechanical Testing of Dry Slime Threads

Tensile properties of dry slime threads were measured using the glass microbeam apparatus described above fitted with a thicker glass beam of diameter 124 μm. Preliminary tensile tests revealed that it is not possible to pull slime threads out of water directly into air without some of their proteins undergoing an $\alpha\rightarrow\beta$ transition. This effect can be attributed to the surface tension forces that resist pulling a slime thread through the air-water interface. In order to circumvent this problem, slime threads were unraveled and mounted in water, and the water gradually replaced with ethanol using the procedure described above, resulting in a final ethanol concentration of about 95% (i.e. 26 changes). The lower surface tension and the dehydrating/stiffening effect of the ethanol allowed the threads to pass through the ethanol/air interface without major deformation. Mechanical tests were conducted at room temperature (~20° C.) in air at ambient humidity, which was 40% on average, and varied little over the course of the experiments.

5.3 Slime Thread Diameter Measurements

For each slime thread segment tested, the diameter of an adjacent piece of thread was measured using a Hitachi™S-4700 scanning electron microscope (SEM). Samples were transferred to mirror-polished SEM grids, secured with a bead of epoxy at either end, and gold sputter coated under vacuum for 3.2 minutes, resulting in about a 10 nm gold coating. Digital images of threads were captured at an acceleration voltage of 5.0 kV at 18.0k times magnification (FIG. 3.5). Thread diameter was measured from calibrated digital images using Scion Image™v.3b analysis software (Scion Corp., Frederick, Md., USA).

5.4 Draw Processing

Dry, untransformed threads were obtained as described above. Load-unload cycles were performed by conducting tensile tests as described above, and reversing the 72-rpm motor driving the traveler arm when the desired maximum strain was reached. For consecutive load cycles, a second video dimension analyzer tracked the movement of the traveler arm, which allowed simultaneous collection of both force and extension data.

As will be apparent to those skilled in the art in the light of the foregoing disclosure, many alterations and modifications are possible in the practice of this invention without departing from the scope thereof. Accordingly, the scope of the invention is to be construed in accordance with the substance defined by the following claims.

REFERENCES

Abumuhor, I. A., Spencer, P. H. and Cohlberg, J. A. (1998). The pathway of assembly of intermediate filaments from recombinant alpha-internexin. *Journal of Structural Biology* 123, 187–198.

Alberts, B., Bray, D., Lewis, J., Raff, M., Roberts, K. and Watson, J. D. (1994). *Molecular Biology of the Cell*. New York: Garland.

Candelas, G. C., A. Oritz and N. Oritz (1988). Features of cell-free translation of a spider fibroin mRNA. *Cell Biol.* 67:173–176.

Cappello, J. (1998). Products comprising substrates capable of enzymatic cross-linking. U.S. Pat. No. 5,773,577.

Cerda, J., Conrad, M., Markl, J., Brand, M. and Herrmann, H. (1998). Zebrafish vimentin: molecular characterization, assembly properties and developmental expression. *European Journal of Cell Biology* 77, 175–187.

Cusack, S., Belrhali, H., Bram, A., Burghammer, M., Perrakis, A. and Riekel, C. (1998). Small is beautiful: protein micro-crystallography. *Nature Structural Biology* 5, 634–637.

Denny, M. (1976). The physical properties of spiders silk and their role in the design of orb webs. *Journal of Experimental Biology* 65, 483–506.

Downing, S. W., Spitzer, R. H., Salo, W. L., Downing, S. D., Saidel, L. J., Koch, E. A. (1981). Hagfish slime gland thread cells: organization, biochemical features, and length. *Science* 212, 326–327.

Fahnestock SR, Yao Z, Bedzyk LA (2000). Microbial production of spider silk proteins (2000) *Reviews in Mol. Biotech.,* 74(2):105–19

Fahnestock, S. R. (1994). Novel, recombinantly produced spider silk analogs. PCT Publication No. WO9429450.

Fernholm, B. (1981). Thread cells from the slime glands of hagfish (Myxinidae). *Acta Zoologica* 62, 137–145.

Fradette, J., Germain, L., Seshaiah, P. and Coulombe, P. A. (1998). The type I keratin 19 possesses distinct and context-dependent assembly properties. *Journal of Biological Chemistry* 273, 35176–35184.

Fraser, R. D. B, MacRae, T. P., Parry, D. A. D. Suzuki, E. (1969). Structure of b-keratin. *Polymer.* 10, 810–26.

Frederick S E, Mangan M E, Carey J B, Gruber P J. Intermediate filament antigens of 60 and 65 kDa in the nuclear matrix of plants: their detection and localization (1992) *Exp Cell Res.* 199(2):213–22.

Fuchs, E. and Cleveland, D. W. (1998). A structural scaffolding of intermediate filaments in health and disease. *Science* 279, 514–9.

Guerette, P. A., Ginzinger, D. G., Weber, B. H. F. and Gosline, J. M. (1996). Silk properties determined by gland-specific expression of a spider fibroin gene family. *Science* 272, 112–115.

Hargreaves A J, Goodbody K C, Lloyd C W. Reconstitution of intermediate filaments from a higher plant (1989). *Biochem J.* 261(2):679–82.

Hearle, J. W. (2000). A critical review of the structural mechanics of wool and hair fibers. *International Journal of Biological Macromolecules* 27, 123–38.

Herrmann, H., Patzelt, U., Wedig, T., Mucke, N., Lustig, A. and Aebi, U. (2000). Critical evaluation of the distinct steps of intermediate filament (IF) assembly. Molecular Biology of the Cell 11, (supplement. Dec.) Abstract #2762. page 534a).

Herrmann, H., Strelkov, S., Feja, B., Rogers, K. R., Brettel, M., Lustig, A., Haner, M., Parry, D. A. D., Steinert, P. M., Burkhard, P. et al. (2000). The intermediate filament protein consensus motif of helix 2B: Atomic structure and contribution to assembly. *Journal of Molecular Biology* 298, 817–832.

Hofmann, I., Herrmann, H. and Franke, W. W. (1991). Assembly and structure of calcium-induced thick vimentin filaments. European Journal of *Cell Biology* 56, 328–41.

Jannatipour, M. and Rokeach, L. A. (1998). A *Schizosaccharomyces pombe* gene encoding a novel polypeptide with a predicted alpha-helical rod structure found in the myosin and intermediate-filament families of proteins. *Biochim Biophys Acta,* 30; 1399(1):67–72.

Knight, D. P., Knight, M. M. and Vollrath, F. (2000). Beta transition and stress-induced phase separation in the spinning of spider dragline silk. *Int. J. Biol. Macromol.* 27, 205–10.

Koch, E. A., Spitzer, R. H., Pithawalla, R. B. and Parry, D. A. (1994). An unusual intermediate filament subunit from the cytoskeletal biopolymer released extracellularly into seawater by the primitive hagfish (*Eptatretus stouti*). *Journal of Cell Science* 107, 3133–44.

Koch, E. A., Spitzer, R. H., Pithawalla, R. B., Castillos, F. A., 3rd and Parry, D. A. (1995). Hagfish biopolymer: a type I/type II homologue of epidermal keratin intermediate filaments. *International Journal of Biological Macromolecules* 17, 283–92.

Lazaris, A., Arcidiacono, S., Huang, Y., Zhou, J. F., Duguay, F., Chretien, N., Welsh, E. A., Soares, J. W. and Karatzas, C. N. (2002). Spider silk fibers spun from soluble recombinant silk produced in mammalian cells. *Science* 295, 472–476.

Ma et al., *A 'hot-spot' mutation alters the mechanical properties of keratinfilament networks*, Nat. Cell Biol. 3(5):503–506 (2001).

Mack, J. W. et al., *The mechanism of interaction of filaggrin with intermediate filaments: The ionic zipper hypothesis* J. Mol. Biol. 232: 50–66 (1993).

Matoltsty, A. G. (1965) In "Biology of Skin and Hair Growth" (A. G. Lyne and B. F. Short, ed.), Angus and Robertson, Sydney.

Masuda K, Xu Z J, Takahashi S, Ito A, Ono M, Nomura K, Inoue M. (1997). Peripheral framework of carrot cell nucleus contains a novel protein predicted to exhibit a long alpha-helical domain. *Exp Cell Res.* 10;232(1): 173–81.

Pandey, A (2001). Plants to make silk. *Trends Genet.* 2001 17(8):442.

Parry, D. A. and Steinert, P. M. (1999). Intermediate filaments: molecular architecture, assembly, dynamics and polymorphism. *Quarterly Reviews of Biophysics* 32, 99–187.

Porter, R. M., Hutcheson, A. M., Rugg, E. L., Quinlan, R. A. and Lane, E. B. (1998). cDNA cloning, expression, and assembly characteristics of mouse keratin 16. *Journal of Biological Chemistry* 273, 32265–32272.

Puchtler, H., Waldrop, F. S. and Meloan, S. N. (1985). A review of light, polarization and fluorescence microscopic methods for amyloid. *Appl. Pathol.* 3, 5–17.

Riekel, C., Madsen, B., Knight, D. and Vollrath, F. (2000). X-ray diffraction on spider silk during controlled extrusion under a synchrotron radiation X-ray beam. *Biomacromol.* 1, 622–26.

Scheller J, Guhrs K H, Grosse F, Conrad U. Production of spider silk proteins in tobacco and potatos (2001). *Nat Biotechnol.* 19(6):573–7.

Spitzer, R. H., Downing, S. W., Koch, E. A., Salo, W. L. and Saidel, L. J. (1984). Hagfish slime gland thread cells. II. Isolation and characterization of intermediate filament components associated with the thread. *Journal of Cell Biology* 98, 670–7.

Spitzer, R. H., Koch, E. A. and Downing, S. W. (1988). Maturation of hagfish gland thread cells: composition and characterization of intermediate filament polypeptides. *Cell Motility & the Cytoskeleton* 11, 31–45.

Stedronsky, E. R. and Cappello, J. (2000). U.S. Pat. No. 6,033,654.

Steinbock F A, et al., *Dose-dependent linkage, assembly inhibition and disassembly of vimentin and cytokeratin* 5/14 *filaments through plectin's intermediatefilament-binding domain*, J. Cell Sci. 113(3):483–491 (2000).

The Encyclopedia of Polymer Science and Engineering (1988). Edited by H. F. Mark, N. M. Bikales, B. G. Overberger, G. Menges and J. I. Kroschwitz. 5000 pp. ISBN: 0471865192.

Vollrath, F. and Knight, D. P. (2001). Liquid crystalline spinning of spider silk. *Nature* 410, 541–548.

Wang, J., Karabinos, A., Schunemann, J., Riemer, D. and Weber, K. (2000). The epidemal intermediate filament proteins of tunicates are distant keratins; a polymerisation-competent hetero coiled coil of the Styela D protein and *Xenopus* keratin 8. *European Journal of Cell Biology* 79, 478–487.

Wang, N. and Stamenovic, D. (2000). Contribution of intermediate filaments to cell stiffness, stiffening, and growth. American Journal of Physiology—*Cell Physiology* 279, C 188–94.

Work, R. W. (1982). A physico-chemical study of the supercontraction of spider major ampullate fibers. *Textile Research Journal* 59, 349–356.

Wu, K. C., Bryan, J. T., Morasso, M. I., Jang, S. I., Lee, J. H., Yang, J. M., Marekov, L. N., Parry, D. A. D. and Steinert, P. M. (2000). Coiled-coil trigger motifs in the 1B and 2B rod domain segments are required for the stability of keratin intermediate filaments. *Molecular Biology of the Cell* 11, 3539–3558.

Yoon, M., Yoon, K., Moir, R. D., Matus, A. and Goldman, R. D. (2000). The motile properties and assembly states of intermediate filament (IF) networks in response to growth factors. Molecular Biology of the Cell 11. (supplement. Dec.) Abstract #2765. page 534a.

What is claimed is:

1. A method of making protein filament based materials, the method comprising:

obtaining α-helix containing filaments of filament-forming α-helical proteins; and, stretching at least some of the α-helix containing filaments sufficiently to alter the structure of the at least some of the α-helix containing filaments from an α-helical structure to a β-sheet structure;

wherein the α-helix containing filaments comprise intermediate filaments substantially free of a protein matrix, and wherein the altered filaments substantially retain the β-sheet structure after the stretching.

2. A method according to claim 1, comprising forming the α-helix containing filaments into a larger structure wherein stretching at least some of the α-helix containing filaments comprises stretching the larger structure.

3. A method according to claim 2, wherein stretching the at least some of the α-helix containing filaments occurs substantially simultaneously with formation of the larger structure.

4. A method according to claim 2, wherein the larger structure comprises a fibre, film, or a bulk material.

5. A method according to claim 1, wherein a majority of the α-helix containing filaments are aligned in one or more preferred directions.

6. A method according to claim 5, wherein the α-helix containing filaments are aligned by adding an alignment-promoting material selected from the group consisting of a cytolinker protein, filaggrin, homerin, and plakin.

7. A method according to claim 5, wherein the α-helix containing filaments are aligned by altering pH, ionic strength, or composition of a buffer containing the α-helix containing filaments.

8. A method according to claim 5, wherein the α-helix containing filaments are aligned by flow, by charge, or by substrate directed alignment.

9. A method according to claim 1, wherein obtaining α-helix containing filaments comprises obtaining the filament-forming α-helical proteins and forming the α-helix containing filaments from the filament-forming α-helical proteins.

10. A method according to claim 9, wherein forming the α-helix containing filaments from the filament-forming α-helical proteins comprises providing conditions suitable for causing the filament-forming α-helical proteins to self-assemble into the α-helix containing filaments.

11. A method according to claim 1, wherein the α-helix containing filaments have diameters in the range of 1 nm to 16 nm.

12. A method according to claim 1, wherein the α-helix containing filaments have lengths in the range of 100 nm to 100 μm.

13. A method according to claim 12, wherein the α-helix containing filaments have lengths in the range of 5 μm to 30 μm.

14. A method according to claim 1, wherein the intermediate filaments have diameters in the range of 7 nm to 16 nm.

15. A method according to claim 14, wherein the intermediate filaments are made up of filament-forming α-helical proteins having weights not exceeding 100 kDa.

16. A method according to claim 15, wherein the intermediate filaments comprise one or more proteins having a weight of approximately 67 kDa.

17. A method according to claim 1, wherein the α-helix containing filaments comprise hagfish slime threads.

18. A method according to claim 17, wherein the hagfish slime threads are derived from *Eptatretus stoutii*.

19. A method according to claim 1, wherein stretching the at least some of the α-helix containing filaments comprises repeatedly applying to and removing from the at least some of the α-helix containing filaments a load sufficient to alter a structure of the at least some of the α-helix containing filaments.

20. A method according to claim 19, comprising drying the at least some of the α-helix containing filaments before stretching the at least some of the α-helix containing filaments.

21. A method according to claim 20, wherein stretching the at least some of the α-helix containing filaments comprises extending the α-helix containing filaments to a strain in excess of $\epsilon=0.025$.

22. A method according to claim 21, wherein stretching the at least some of the α-helix containing filaments comprises extending the α-helix containing filaments to a strain not exceeding about $\epsilon=1.0$.

23. A method according to claim 19, comprising stretching the at least some of the α-helix containing filaments when the at least some of the α-helix containing filaments are wet.

24. A method according to claim 23, wherein stretching the at least some of the α-helix containing filaments is performed in the presence of one or more of: one or more aqueous solvents; one or more non-aqueous solvents; and one or more plasticizers.

25. A method according to claim 23, wherein stretching the at least some of the α-helix containing filaments comprises extending the α-helix containing filaments to a strain of at least about $\epsilon=0.35$.

26. A method according to claim 25 wherein stretching the at least some of the α-helix containing filaments comprises extending the α-helix containing filaments to a strain not exceeding about $\epsilon=2.2$.

27. A method according to claim 1, wherein obtaining the α-helix containing filaments comprises concentrating the α-helix containing filaments to a concentration of at least 0.5 mg/ml.

28. A method according to claim 27 wherein obtaining the α-helix containing filaments comprises concentrating the α-helix containing filaments to a concentration in the range of 0.5 mg/ml to 100 mg/ml.

29. A method according to claim 27, wherein concentrating the α-helix containing filaments is performed in an aqueous solution.

30. A method according to claim 1, comprising promoting cross-linking between proteins of the α-helix containing filaments.

31. A method according to claim 30, wherein promoting cross-linking between proteins of the α-helix containing filaments is performed before stretching at least some of the α-helix containing filaments.

32. A method according to claim 30, wherein promoting cross-linking between proteins of the α-helix containing filaments is performed after stretching at least some of the α-helix containing filaments.

33. A method according to claim 1, comprising plasticizing the at least some of the α-helix containing filaments.

34. A method according to claim 33, wherein plasticizing the at least some of the α-helix containing filaments is performed before stretching the at least some of the α-helix containing filaments.

35. A method according to claim 33, wherein plasticizing the at least some of the α-helix containing filaments is performed after stretching the at least some of the α-helix containing filaments.

36. A method according to claim 1, wherein the α-helix containing filaments comprise recombinant proteins.

37. A method according to claim 1, wherein obtaining the filament-forming α-helical proteins comprises expressing the filament-forming α-helical proteins in a cell free translation system.

38. A method according to claim 1, wherein obtaining the filament-forming α-helical proteins comprises synthesizing the filament-forming α-helical proteins by chemical peptide synthesis.

* * * * *